US011174535B2

(12) United States Patent
Chevy et al.

(10) Patent No.: US 11,174,535 B2
(45) Date of Patent: Nov. 16, 2021

(54) ISOTROPIC PLATES MADE FROM ALUMINUM-COPPER-LITHIUM ALLOY FOR MANUFACTURING AIRCRAFT FUSELAGES

(71) Applicant: CONSTELLIUM ISSOIRE, Issoire (FR)

(72) Inventors: Juliette Chevy, Moirans (FR); Bernard Bes, Seyssins (FR); Frank Eberl, Issoire (FR)

(73) Assignee: CONSTELLIUM ISSOIRE, Issoire (FR)

( * ) Notice: Subject to any disclaimer, the term of this patent is extended or adjusted under 35 U.S.C. 154(b) by 686 days.

(21) Appl. No.: 15/515,891

(22) PCT Filed: Oct. 1, 2015

(86) PCT No.: PCT/FR2015/052634
§ 371 (c)(1),
(2) Date: Mar. 30, 2017

(87) PCT Pub. No.: WO2016/051099
PCT Pub. Date: Apr. 7, 2016

(65) Prior Publication Data

US 2017/0306454 A1 Oct. 26, 2017

(30) Foreign Application Priority Data

Oct. 3, 2014 (FR) ..... 1402237

(51) Int. Cl.
*C22C 21/16* (2006.01)
*C22F 1/057* (2006.01)

(52) U.S. Cl.
CPC ..... *C22C 21/16* (2013.01); *C22F 1/057* (2013.01)

(58) Field of Classification Search
CPC ..... C22C 21/16; C22C 21/12; C22C 21/00; C22C 1/026; C22F 1/057; C22F 1/04
(Continued)

(56) References Cited

U.S. PATENT DOCUMENTS 5,032,359 A 7/1991 Pickens et al.
5,455,003 A * 10/1995 Pickens ..... C22C 21/00 420/529
(Continued)

FOREIGN PATENT DOCUMENTS

CN 101 967 588 A 2/2011
CN 101967588 A * 2/2011
(Continued)

OTHER PUBLICATIONS

Machine translation of CN-101967588-A, 8 pages. (Year: 2011).*
(Continued)

*Primary Examiner* — Matthew E. Hoban
*Assistant Examiner* — Lynne Edmondson
(74) *Attorney, Agent, or Firm* — McBee Moore & Vanik IP, LLC

(57) ABSTRACT

The invention relates to a plate with a thickness of 0.5 to 9 mm with an essentially recrystallized granular structure, made from an alloy based on aluminum, comprising 2.8 to 3.2% by weight Cu, 0.5 to 0.8% by weight Li, 0.1 to 0.3% by weight Ag, 0.2 to 0.7% by weight Mg, 0.2 to 0.6% by weight Mn, 0.01 to 0.15% by weight Ti, a quantity of Zn below 0.2% by weight, a quantity of Fe and Si of less than or equal to 0.1% by weight each, and unavoidable impurities to a proportion of less than or equal to 0.05% by weight each and 0.15% by weight in total, said plate being obtained by a method comprising casting, homogenization, hot rolling and optionally cold rolling, solution heat treatment, quenching and aging. The plates according to the invention are
(Continued)

advantageous in particular for the manufacture of aircraft fuselage panels.

19 Claims, 2 Drawing Sheets

(58) Field of Classification Search
USPC ..... 148/415, 416, 437, 502, 438, 549, 688, 148/699; 420/528, 532
See application file for complete search history.

(56) References Cited

U.S. PATENT DOCUMENTS

| | | | | |
|---|---|---|---|---|
| 7,229,509 | B2 | 6/2007 | Cho et al. | |
| 7,438,772 | B2 | 10/2008 | Rioja et al. | |
| 2008/0289728 | A1* | 11/2008 | Bes | C22C 21/16 148/552 |
| 2009/0142222 | A1 | 6/2009 | Colvin et al. | |
| 2011/0209801 | A2 | 9/2011 | Warner et al. | |
| 2011/0247730 | A1 | 10/2011 | Yanar et al. | |
| 2013/0092294 | A1 | 4/2013 | Eberl et al. | |

FOREIGN PATENT DOCUMENTS

| | | | |
|---|---|---|---|
| CN | 102 021 457 | A | 4/2011 |
| CN | 103874775 | A | 6/2014 |
| WO | 2006/131627 | A1 | 12/2006 |

OTHER PUBLICATIONS

Trivoulas et al. "The effect of Mn and Zr dispersoid-forming additions on recrystallization resistance in Al—Eu—Li AA2198 sheet", vol. 77 (2014), pp. 1-16, XP-029038688.
Trivoulas et al. "Effects of Combined Zr and Mn Additions on Dispersoid Formation and Recrystallisation Behavior or AA2198 Sheet", vol. 89-91 (2010), pp. 568-573, XP055190732.
International Alloy Designations and Chemical Composition Limits for Wrought Aluminum and Wrought Aluminum Alloys . . . (2009), The Aluminum Association, Inc., pp. 1-37, XP055136121.
Timothy Warner "Recently-developed aluminium solutions for aerospace applications", (2006), pp. 1271-1278, XP055135031.
Decreus B. et al. "The influence of Cu/Li ratio on precipitation in Al—Cu—Li-x alloys", Acta materialia, Elsevier, Oxford, GB, vol. 61, No. 6 (2013), pp. 2207-2218, XP028979926.
International Search Report of PCT/FR2015/052634 dated Feb. 4, 2016.

* cited by examiner

ISOTROPIC PLATES MADE FROM ALUMINUM-COPPER-LITHIUM ALLOY FOR MANUFACTURING AIRCRAFT FUSELAGES

CROSS REFERENCE TO RELATED APPLICATIONS

This application is a § 371 National Stage Application of PCT/FR2015/052634, filed Oct. 1, 2015, which claims priority to FR 14/02237, filed Oct. 3, 2014.

BACKGROUND

Field of the Invention

The invention relates to rolled aluminum-copper-lithium products, more particularly such products and the methods for manufacturing and using same, intended in particular for aeronautical and aerospace construction.

Description of Related Art

Rolled aluminum alloy products are developed to produce fuselage components intended in particular for the aeronautical industry and the aerospace industry.

Aluminum-copper-lithium alloys are particularly promising for manufacturing this type of product.

The patent U.S. Pat. No. 5,032,359 describes a large family of aluminum-copper-lithium alloys in which adding magnesium and silver, in particular at between 0.3 and 0.5 percent by weight, increases the mechanical strength.

The patent U.S. Pat. No. 5,455,003 describes a method for manufacturing Al—Cu—Li alloys that have improved mechanical strength and toughness at cryogenic temperature, in particular by means of suitable work hardening and aging. This patent recommends in particular the composition, in percentages by weight, Cu=3.0-4.5, Li=0.7-1.1, Ag=0-0.6, Mg=0.3-0.6 and Zn=0-0.75.

The patent U.S. Pat. No. 7,438,772 describes alloys comprising, in percentages by weight, Cu: 3-5, Mg: 0.5-2, Li: 0.01-0.9 and discourages the use of higher lithium contents because of a degradation of the compromise between toughness and mechanical strength.

The patent U.S. Pat. No. 7,229,509 describes an alloy comprising (% by weight): (2.5-5.5) Cu, (0.1-2.5) Li, (0.2-1.0) Mg, (0.2-0.8) Ag, (0.2-0.8) Mn, 0.4 max Zr or other grain refiners such as Cr, Ti, Hf, Sc, V.

The patent application US 2009/142222 A1 describes alloys comprising (as a % by weight) 3.4 to 4.2% Cu, 0.9 to 1.4% Li, 0.3 to 0.7% Ag, 0.1 to 0.6% Mg, 0.2 to 0.8% Zn, 0.1 to 0.6% Mn and 0.01 to 0.6% at least one element for controlling the granular structure. This application also describes a method for manufacturing extruded products.

The patent application US 2011/0247730 describes alloys comprising (as % by weight), 2.75 to 5.0% Cu, 0.1 to 1.1% Li, 0.3 to 2.0% Ag, 0.2 to 0.8% Mg, 0.50 to 1.5% Zn, up to 1.0% Mn, with a Cu/Mg ratio between 6.1 and 17, this alloy having low sensitivity to working.

The patent application CN 101967588 describes alloys with a composition (as % by weight) Cu 2.8-4.0; Li 0.8-1.9; Mn 0.2-0.6; Zn 0.20-0.80, Zr 0.04-0.20, Mg 0.20-0.80, Ag 0.1-0.7, Si≤0.10, Fe≤0.10, Ti≤0.12, it teaches the combined addition of zirconium and manganese.

The patent application US 2011/209801 relates to wrought products such as extruded, rolled and/or forged products, made from an alloy based on aluminum comprising, as % by weight, Cu: 3.0-3.9; Li: 0.8-1.3; Mg: 0.6-1.0; Zr: 0.05-0.18; Ag: 0.0-0.5; Mn: 0.0-0.5; Fe+Si<=0.20; at least one element from Ti: 0.01-0.15; Sc: 0.05-0.3; Cr: 0.05-0.3; Hf: 0.05-0.5; other elements <=0.05 each and <=0.15 in total, the remainder aluminum, the products being particularly useful for producing thick aluminum products intended for producing structure elements for the aeronautical industry.

The characteristics necessary for aluminum plates intended for fuselage applications are described for example in the patent EP 1 891 247. It is desirable in particular for the plate to have a high yield strenght (for resisting buckling) and a high toughness under plane strain stress, characterized in particular by a high apparent breaking stress intensity factor ($K_{app}$) and a long R curve.

The patent EP 1 966 402 describes an alloy comprising 2.1 to 2.8% by weight Cu, 1.1 to 1.7% by weight Li, 0.1 to 0.8% by weight Ag, 0.2 to 0.6% by weight Mg, 0.2 to 0.6% by weight Mn, a quantity of Fe and Si less than or equal to 0.1% by weight each, and unavoidable impurities in a proportion of less than or equal to 0.05% by weight each and 0.15% by weight in total, the alloy being substantially free from zirconium, particularly suitable for obtaining recrystallized sheets.

Fuselage plates may be stressed in several directions and isotropic thin plates (sheets) having high properties and balanced for mechanical strength in the L and TL directions and in toughness for the L-T and T-L directions are highly sought. In addition it has been found that thin plates obtained with certain alloys have high properties at certain thicknesses, for example 4 mm may in some cases have less high or anisotropic properties than another thickness, for example 2.5 mm. It is not often advantageous industrially to use different alloys for different thicknesses and an alloy making it possible to achieve high isotropic properties whatever the thickness would be particularly advantageous.

There exists a need for thin plates, particularly with a thickness of 0.5 to 9 mm, made from an aluminum-copper-lithium alloy having improved and isotropic properties compared with those of known products, in particular in terms of mechanical strength in the L and TL directions and toughness for the L-T and T-L directions, and this over the whole of this thickness range.

SUMMARY

The subject matter of the invention is a 0.5 to 9 mm thick plate with an essentially recrystallized granular structure made from an aluminum-based alloy comprising 2.8 to 3.2% by weight Cu,
0.5 to 0.8% by weight Li,
0.1 to 0.3% by weight Ag,
0.2 to 0.7% by weight Mg,
0.2 to 0.6% by weight Mn,
0.01 to 0.15% by weight Ti, a quantity of Zn of less than 0.2% by weight, a quantity of Fe and Si of less than or equal to 0.1% by weight each, and unavoidable impurities to a proportion of less than or equal 0.05% by weight each and 0.15% by weight in total, said plate being obtained by a method comprising casting, homogenization, hot rolling and optionally cold rolling, solution treatment, quenching and aging.

Another subject matter of the invention is the method for manufacturing a plate according to the invention with a thickness of 0.5 to 9 mm made from aluminum-based alloy in which, successively a) a liquid metal bath is elaborated, comprising 2.8 to 3.2% by weight Cu, 0.5 to 0.8% by weight Li, 0.1 to 0.3% by weight Ag, 0.2 to 0.7% by weight Mg, 0.2 to 0.6% by weight Mn, 0.01 to 0.15% by weight Ti, a quantity of Zn of less than 0.2% by weight, a quantity of Fe and Si of less than or equal to 0.1% by weight each, and unavoidable impurities to a proportion of less than or equal 0.05% by weight each and 0.15% by weight in total, b) an ingot is cast from said bath of liquid metal;

c) said ingot is homogenized at a temperature of between 480° C. and 535° C.;

d) said ingot is rolled by hot rolling and optionally cold into a plate having a thickness of between 0.5 mm and 9 mm;

e) solution heat treatment is carried out at a temperature of between 450° C. and 535° C. and said plate is quenched;

h) said plate is stretched in a controlled manner with a permanent deformation set of 0.5 to 5%, the total cold deformation set after solution heat treatment and quenching being less than 15%;

i) aging is carried out, comprising heating to a temperature of between 130° and 170° C. and preferably between 150° and 160° C. for 5 to 100 hours and preferably 10 to 40 hours.

Yet another subject matter of the invention is the use of a plate according to the invention in a fuselage panel for an aircraft.

DETAILED DESCRIPTION OF A PREFERRED EMBODIMENT

Figure 1:
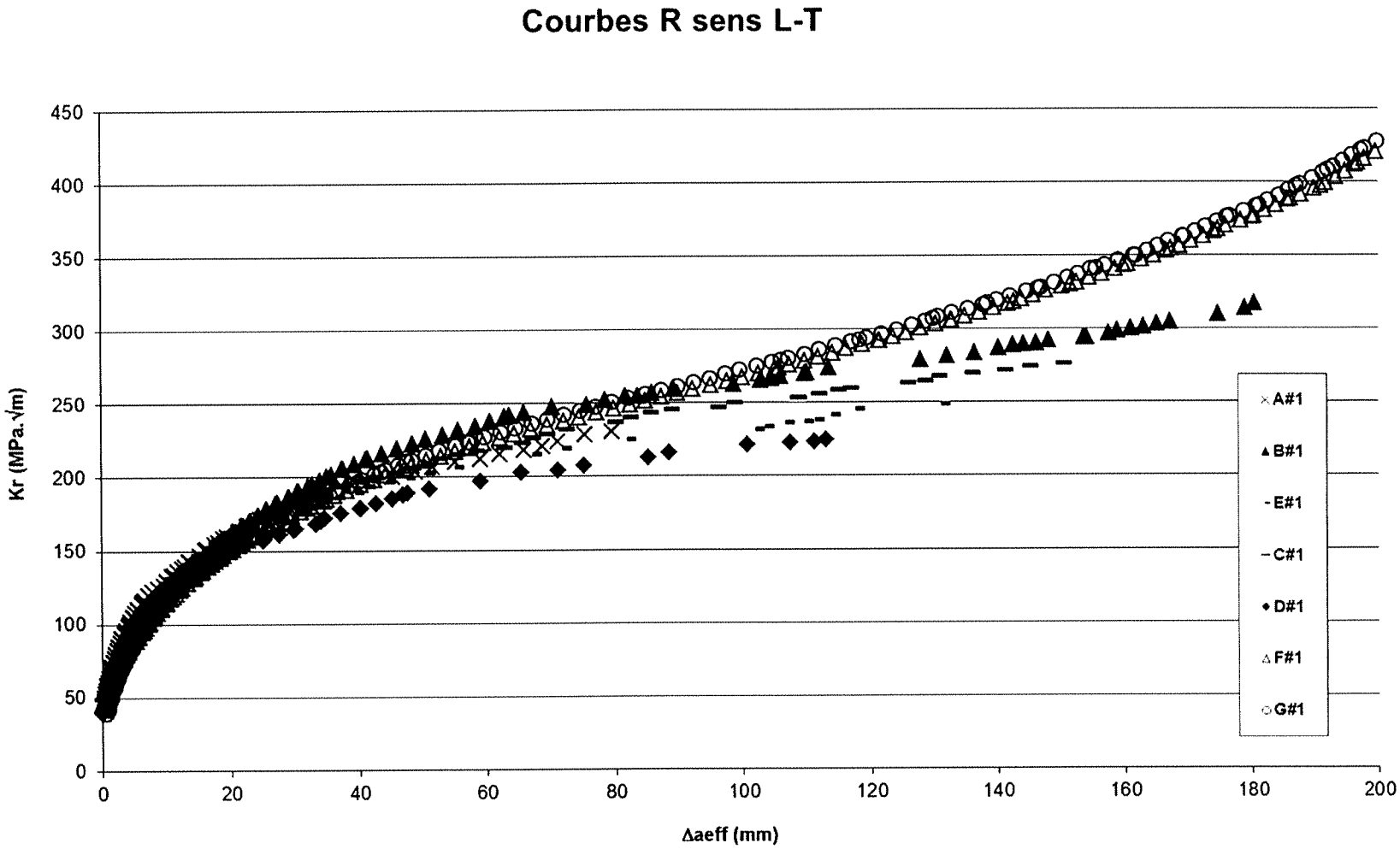
FIG. 1—R curves obtained in the L-T direction on plates with a thickness of 4 to 5 mm for test pieces 760 mm wide.

Unless mentioned to the contrary, all the indications concerning the chemical composition of the alloys are expressed as a percentage by weight based on the total weight of the alloy. The expression 1.4 Cu means that the copper content expressed as % by weight is multiplied by 1.4. The designation of the alloys is done in conformity with the rules of the Aluminum Association, known to persons skilled in the art. Unless mentioned to the contrary the definitions of the metallurgical states indicated in the European standard EN 515 apply.

The static mechanical characteristics under traction, in other words the ultimate tensile strength $R_m$, the conventional tensile yield strength at 0.2% elongation $R_{p0.2}$, and the elongation at break A %, are determined by a tensile test in accordance with NF EN ISO 6892-1, the sampling and direction of the test being defined by EN 485-1.

In the context of the present invention, essentially, non-recrystallized granular structure means a granular structure such that the rate of recrystallization at half thickness is less than 30% and preferably less than 10%, and essentially recrystallized granular structure means a granular structure such that the rate of recrystallization at half thickness is greater than 70% and preferably greater than 90%. The rate of recrystallization is defined as the fraction of surface area on a metallographic section occupied by recrystallized grains.

The grain sizes are measured in accordance with ASTM E 112.

A curve giving the effective stress intensity factor as a function of the effective crack extension, known as the R curve, is determined in accordance with ASTM E561. The critical stress intensity factor $K_c$, in other words the intensity factor that makes the crack unstable, is calculated from the R curve. The stress intensity factor $K_{co}$ is also calculated by attributing the initial crack length at the commencement of the monotonic load, to the critical load. These two values are calculated for a test piece of the required form. $K_{app}$ represents the factor $K_{co}$ corresponding to the test piece that was used for carrying out the R curve test. $K_{eff}$ represents the factor $K_c$ corresponding to the test piece that was used for carrying out the R curve test. Kr60 represents the effective stress intensity factor for an effective crack extension Δaeff of 60 mm. Unless mentioned to the contrary, the crack size at the end of the fatigue precracking stage is W/3 for test pieces of the M(T) type, in which W is the width of the test piece as defined in ASTM E561.

Unless mentioned to the contrary, the definitions of EN 12258 apply.

The copper content of the products according to the invention is between 2.8 and 3.2% by weight. In an advantageous embodiment of the invention, the copper content is between 2.9 and 3.1% by weight.

The lithium content of the products according to the invention is between 0.5 and 0.8% by weight and preferably between 0.55% and 0.75% by weight. Advantageously the lithium content is at least 0.6% by weight. In one embodiment of the invention, the lithium content is between 0.64% and 0.73% by weight. The addition of lithium may help to increase the mechanical strength and toughness, an excessively high or excessively low content does not make it possible to obtain a high toughness value and/or a sufficient tensile strength.

The magnesium content of the products according to the invention is between 0.2 and 0.7% by weight, preferably between 0.3 and 0.5 by weight and preferably between 0.35 and 0.45% by weight.

The manganese content is between 0.2 and 0.6% by weight and preferably between 0.25 and 0.35% by weight. In one embodiment of the invention the manganese content is no more than 0.45% by weight. Adding manganese in the claimed quantity makes it possible to control the granular structure while avoiding the detrimental effect on toughness that an excessively high content would cause.

The silver content is between 0.1 and 0.3% by weight. In an advantageous embodiment of the invention the silver content is between 0.15 and 0.28% by weight.

The titanium content is between 0.01 and 0.15% by weight. Advantageously the titanium content is at least 0.02% by weight and preferably at least 0.03% by weight. In an advantageous embodiment of the invention the titanium content is no more than 0.1% by weight and preferably no more than 0.05% by weight. Adding titanium helps to control the granular structure, in particular during casting.

The iron and silicon contents are each no more than 0.1% by weight. In an advantageous embodiment of the invention the iron and silicon contents are no more than 0.08% and preferentially no more than 0.04% by weight. A controlled and limited iron and silicon content helps to improve the compromise between mechanical strength and damage tolerance.

The zinc content is less than 0.2% by weight and preferably less than 0.1% by weight. The zinc content is advantageously less than 0.04% by weight.

Unavoidable impurities are maintained at a content of less than or equal to 0.05% by weight each and 0.15% by weight in total.

In particular the zirconium content is less than or equal to 0.05% by weight, preferentially less than or equal to 0.04% by weight and preferably less than or equal to 0.03% by weight.

The method for manufacturing plates according to the invention comprises steps of elaborating, casting, rolling, solution heat treating, quenching, controlled stretching and aging.

In a first step, a bath of liquid metal is elaborated so as to obtain an aluminum alloy with a composition according to the invention.

The bath of liquid metal is next cast in the form of a rolling ingot.

The rolling ingot is next homogenized at a temperature of between 480° C. and 535° C. and preferably between 490° C. and 530° C. and preferably between 500° C. and 520° C. The duration of homogenization is preferably between 5 and 60 hours.

In the context of the invention, an excessively low homogenization temperature or the absence of homogenization does not make it possible to achieve improved and isotropic properties compared with those of the known products, in particular in terms of mechanical strength in the L and TL directions and toughness for the L-T and T-L directions, and this over the whole of this thickness range.

After homogenization, the rolling ingot is in general cooled to ambient temperature before being preheated with a view to being hot worked. The objective of the preheating is to achieve a temperature preferably between 400° and 500° C. allowing working by hot rolling.

The hot and optionally cold rolling is carried out so as to obtain a plate with a thickness of 0.5 to 9 mm.

Advantageously, during the hot rolling, a temperature above 400° C. is maintained up to a thickness of 20 mm and preferably a temperature above 450° C. up to a thickness of 20 mm. Intermediate heat treatments during rolling and/or after rolling may be carried out in some cases. However, preferably, the method does not comprise any intermediate heat treatment during rolling and/or after rolling. The plate thus obtained is then solution heat treated by heat treatment between 450° and 535° C., preferably between 490° C. and 530° C. and preferably between 500° C. and 520° C., preferably for 5 minutes to 2 hours, and then quenched. Advantageously, the duration of solution heat treatment is no more than 1 hour so as to minimize surface oxidation.

It is known to persons skilled in the art that the aforementioned conditions for solution heat treatment must be chosen according to the thickness and composition so as to put the hardening elements in solid solution.

The plate next undergoes cold worked by controlled stretching with permanent deformation set of 0.5 to 5% and preferentially 1 to 3%. Known steps such as rolling, levelling, flattening, straightening or shaping can optionally have been carried out after solution heat treatment and quenching and before or after the controlled stretching; however, the total cold work after solution heat treatment and quenching must remain less than 15% and preferably less than 10%. High cold works after solution heat treatment and quenching in fact cause the appearance of numerous shear bands passing through several grains, these shear bands not being desirable. Typically, the quenched plate can be subjected to a levelling or flattening step, before or after the controlled traction. Here "levelling/flattening" means a step of cold work without permanent deformation or with permanent deformation set less than or equal to 1%, improving the flatness.

Aging is carried out, comprising heating to a temperature between 130° and 170° C. and preferably between 150° C. and 160° C. for 5 to 100 hours and preferably from 10 to 40 hours. Preferably, the final temper is a T8 temper.

In one embodiment of the invention, a short heat treatment is carried out after controlled stretching and before aging so as to improve the formability of the plates. The plates can thus be shaped by a method such as stretching-forming before being aged.

The granular structure of the plates according to the invention is essentially recrystallized. The combination of the composition according to the invention and transformation parameters makes it possible to control the anisotropy index of the recrystallized grains. Thus the plates according to the invention are such that the anisotropy index of the grains measured at half thickness according to ASTM E112 by the intercept method in the L/TC plane is less than 20, preferably less than 15 and preferably less than 10. Advantageously, for plates with a thickness of less than or equal to 3 mm, the anisotropy index of the grains measured at half thickness according to ASTM E112 by the intercept method in the L/TC plane is less than or equal to 8, preferably less than or equal to 6, and preferably less than or equal to 4.

The plates according to the invention have advantageous properties whatever the thickness of the products.

The plates according to the invention with a thickness of between 0.5 and 9 mm and particularly between 1.5 and 6 mm advantageously have in the T8 temper at least one of the following pairs of properties a toughness under plane strain stress Kapp, measured on test pieces of the CCT760 type (2ao=253 mm), in the L-T direction and in the T-L direction, of at least 140 MPa√m and preferentially at least 150 MPa√m and a tensile yield strength $R_{P0.2}$ in the L and TL directions of at least 360 MPa and preferably at least 365 MPa, a toughness under plane strain stress Kr60, measured on test pieces of the CCT760 type (2ao=253 mm), in the L-T direction and in the T-L direction, greater than 190 MPaIm and preferentially greater than 200 MPaIm and an ultimate tensile strength Rm in the L and TL directions of at least 410 MPa and preferably at least 415 MPa, and at least one of the following properties:

a ratio between the toughness under plane strain stress Kapp, measured on test pieces of the CCT760 type (2ao=253 mm), in the T-L and L-T directions, Kapp(T-L/Kapp (L-T), of between 0.85 and 1.15 and preferably between 0.90 and 1.10 a ratio between the ultimate tensile strength Rm in the L and TL directions, Rm(L)/Rm(TL), of less than 1.06 and preferably less than 1.05.

Without being bound by any particular theory, the present inventors think that the combination between the composition, in particular the limited proportion of zirconium, the addition of manganese and the chosen quantity of magnesium and the manufacturing method, in particular the homogenization and hot rolling temperatures, makes it possible to obtain the advantageous properties claimed.

The resistance to corrosion, in particular to intergranular corrosion, to exfoliation corrosion and to stress corrosion, of the plates according to the invention is high. In a preferred embodiment of the invention, the plate of the invention can be used without cladding.

The use of plates according to the invention in an aircraft fuselage panel is advantageous. The plates according to the invention are also advantageous in aerospace applications such as the manufacture of the rockets.

EXAMPLE

In this example, plates made from Al—Cu—Li alloy were prepared.

Seven ingots, the composition of which is given in table 1, were cast.

TABLE 1

Composition as % by weight of the ingots

| Alloy | Cu | Li | Mg | Zr | Mn | Ag | Fe | Si | Ti |
|---|---|---|---|---|---|---|---|---|---|
| A | 3.2 | 0.73 | 0.68 | 0.14 | <0.01 | 0.26 | 0.03 | 0.04 | 0.03 |
| B | 3.0 | 0.70 | 0.64 | 0.17 | <0.01 | 0.27 | 0.02 | 0.03 | 0.03 |
| C | 3.0 | 0.73 | 0.35 | 0.15 | <0.01 | 0.27 | 0.02 | 0.03 | 0.03 |
| D | 2.7 | 0.75 | 0.58 | 0.14 | <0.01 | 0.28 | 0.03 | 0.02 | 0.03 |
| E | 2.9 | 0.73 | 0.45 | 0.14 | <0.01 | 0.29 | 0.04 | 0.02 | 0.03 |
| F | 2.9 | 0.68 | 0.42 | 0.03 | 0.28 | 0.28 | 0.03 | 0.02 | 0.03 |
| G | 2.9 | 0.75 | 0.44 | 0.05 | 0.28 | 0.26 | 0.03 | 0.02 | 0.03 |

The ingots were homogenized for 12 hours at 505° C. The ingots were hot rolled in order to obtain plates with a thickness of between 4.2 and 6.3 mm. Some plates were then cold rolled to a thickness of between 1.5 and 2.5 mm. Details of the plates obtained and the aging conditions are given in table 2.

TABLE 2

Details of the plates obtained and of the aging conditions

| Plate | Thickness after hot rolling (mm) | Thickness after cold rolling (mm) | Duration of aging at 155° C. (h) |
|---|---|---|---|
| A#1 | 4.2 | — | 36 |
| A#2 | 4.4 | 1.5 | 36 |
| B#1 | 4.6 | — | 36 |
| B#2 | 4.4 | 1.5 | 36 |
| C#1 | 4.3 | — | 24 |
| C#2 | 4.4 | 1.5 | 24 |
| D#1 | 4.3 | — | 40 |
| D#2 | 6.3 | 2.5 | 40 |
| E#1 | 4.3 | — | 36 |
| E#2 | 6.3 | 2.5 | 36 |
| F#1 | 4.2 | — | 28 |
| F#2 | 4.2 | 2.5 | 28 |
| G#1 | 4.2 | — | 28 |
| G#2 | 4.2 | 2.5 | 28 |

After hot rolling and optionally cold rolling, the plates were solution heat treated at 505° C. and then flattened, stretched with a permanent elongation set of 2% and aged. The aging conditions are not all identical since the increase in the yield strength with the duration of aging differs from one alloy to another. It was sought to obtain an yield strength "at the peak" while limiting the duration of aging. The aging conditions are given in table 2.

The granular structure of the samples was characterized from microscope observation of the cross sections after anodic oxidation under polarized light. The granular structure of the plates was essentially non-recrystallized for all the plates with the exception of plates D #2, E #2. F #1, F #2, G #1 and G #2, for which the granular structure was essentially recrystallized.

For plates where the granular structure was essentially recrystallized, the size of the grains was determined in the L/TC plane at half thickness in accordance with ASTM E112 by the intercept method using microscope observation of the cross sections after anodic oxidation under polarized light. The anisotropy index is the ratio of the grain size measured in the L direction to the grain size measured in the TC direction. The results are presenting in table 3.

TABLE 3

Sizes of grains measured for the samples where the granular structure was essentially recrystallized

| Plate | L direction (μm) | TC direction (μm) | Anisotropy index |
|---|---|---|---|
| D#2 | 1260 | 21 | 60 |
| E#2 | 1100 | 23 | 48 |
| F#1 | 540 | 59 | 9 |
| F#2 | 135 | 37 | 4 |
| G#1 | 678 | 56 | 12 |
| G#2 | 317 | 46 | 7 |

The samples were tested mechanically in order to determine their static mechanical properties and their toughness. The mechanical characteristics were measured in full thickness.

The tensile yield strength Rp0.2, the ultimate tensile strength Rm and the elongation at break A % are set out in table 4.

TABLE 4

Mechanical characteristics expressed in Mpa ($R_{p0.2}$, $R_m$) or as a percentage (A %)

| Plate | $R_{p0.2}$ (L) | $R_m$ (L) | A % (L) | $R_{p0.2}$ (TL) | $R_m$ (TL) | A % (TL) | $R_m$(L)/ $R_m$(TL) |
|---|---|---|---|---|---|---|---|
| A#1 | 469 | 513 | 12.2 | 439 | 481 | 15.8 | 1.07 |
| A#2 | 475 | 522 | 11.7 | 441 | 489 | 14.0 | 1.07 |
| B#1 | 431 | 483 | 13.5 | 419 | 462 | 16.1 | 1.05 |
| B#2 | 431 | 486 | 12.9 | 414 | 460 | 17.1 | 1.06 |
| C#1 | 430 | 471 | 13.6 | 411 | 455 | 15.5 | 1.04 |
| C#2 | 423 | 472 | 12.2 | 399 | 451 | 15.9 | 1.05 |
| D#1 | 420 | 462 | 13.0 | 384 | 428 | 16.3 | 1.08 |
| D#2 | 403 | 437 | 11.6 | 371 | 428 | 13.9 | 1.02 |
| E#1 | 453 | 487 | 12.5 | 428 | 464 | 15.9 | 1.05 |
| E#2 | 433 | 464 | 11.4 | 395 | 458 | 11.4 | 1.01 |
| F#1 | 392 | 430 | 12.5 | 369 | 420 | 12.4 | 1.02 |
| F#2 | 400 | 437 | 11.9 | 368 | 419 | 13.4 | 1.04 |
| G#1 | 402 | 432 | 13.4 | 372 | 424 | 12.7 | 1.02 |
| G#2 | 412 | 440 | 12.9 | 378 | 426 | 13.1 | 1.03 |

Table 5 summarizes the results of the toughness tests on the 760 mm wide CCT test pieces for these samples.

TABLE 5

Results of the R curves for the 760 mm wide CCT test pieces

| | Kapp [MPa√m] | | Kr60 [MPa√m] | | Kapp(T-L)/ |
|---|---|---|---|---|---|
| Plate | T-L | L-T | T-L | L-T | Kapp (L-T) |
| A#1 | 187 | 161 | 247 | 213 | 1.16 |
| A#2 | 160 | 114 | 210 | 151 | 1.40 |
| B#1 | 180 | 178 | 238 | 238 | 1.01 |
| B#2 | 167 | 124 | 223 | 166 | 1.35 |
| C#1 | 182 | 165 | 242 | 219 | 1.10 |
| C#2 | 154 | 127 | 203 | 162 | 1.21 |
| D#1 | 174 | 150 | 230 | 200 | 1.16 |
| D#2 | 147 | 151 | 196 | 201 | 0.97 |
| E#1 | 181 | 159 | 240 | 213 | 1.14 |
| E#2 | 137 | 164 | 181 | 219 | 0.84 |
| F#1 | 154 | 169 | 203 | 223 | 0.91 |

TABLE 5-continued

Results of the R curves for the 760 mm wide CCT test pieces

| Plate | Kapp [MPa√m] T-L | Kapp [MPa√m] L-T | Kr60 [MPa√m] T-L | Kr60 [MPa√m] L-T | Kapp(T-L)/ Kapp (L-T) |
|---|---|---|---|---|---|
| F#2 | 158 | 168 | 208 | 224 | 0.94 |
| G#1 | 153 | 172 | 202 | 228 | 0.89 |
| G#2 | 158 | 172 | 208 | 229 | 0.92 |

Figure 2:
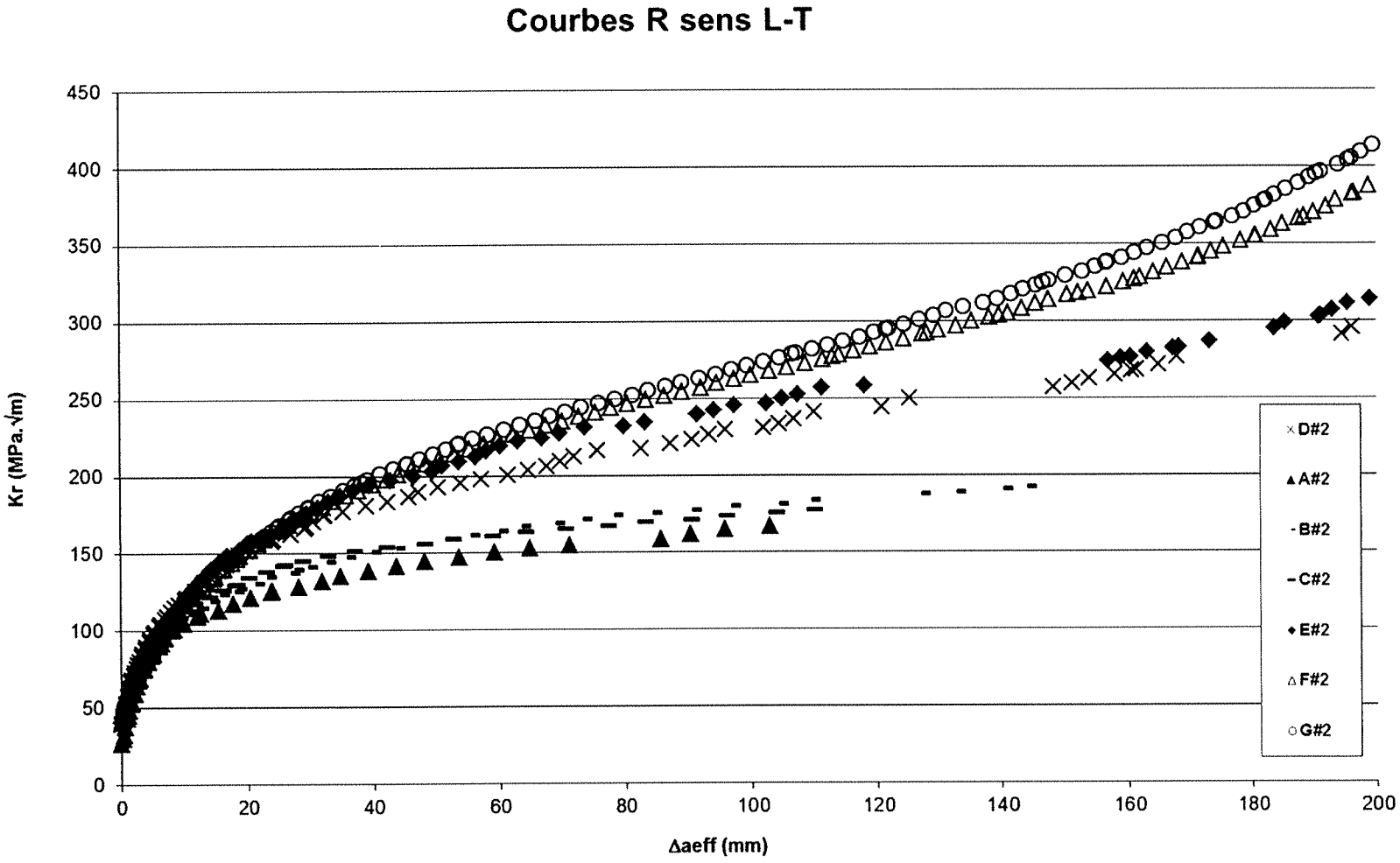
FIG. 2—R curves obtained in the L-T direction on plates with a thickness of 1.5 to 2.5 mm for 760 mm wide test pieces.

FIGS. 1 and 2 illustrate the remarkable toughness of examples F and G according to the invention, in particular in the L-T direction.

Examples F and G demonstrate that it is possible to obtain thin plates according to the invention that have improved anisotropic properties compared with those obtained from the other examples A to E, and in particular with respect to example C, and this over a wide range of typical thicknesses of said thin plates.

The invention claimed is:

1. A plate having a thickness from 0.5 to 9 mm and an essentially recrystallized granular structure made from an aluminum-based alloy consisting of 2.8 to 3.2% by weight Cu,
0.5 to 0.75% by weight Li,
0.1 to 0.3% by weight Ag,
0.2 to 0.7% by weight Mg,
0.2 to 0.6% by weight Mn,
0.01 to 0.15% by weight Ti, a quantity of Zn of less than 0.2% by weight, a quantity of Fe and Si of less than or equal to 0.1% by weight each, and unavoidable impurities to a proportion of less than or equal to 0.05% by weight each and 0.15% by weight in total, wherein a zirconium content is less than or equal to 0.05% by weight, and balance aluminum, said plate being obtained by a method comprising casting, homogenization, hot rolling and optionally cold rolling, solution heat treatment, quenching and aging, and wherein anisotropy index of grains measured at half thickness in accordance with ASTM E112 by the intercept method in L/TC plane is less than 20, and wherein said plate has in the T8 temper at least one of the following pairs of properties:

a toughness under plane strain stress Kapp, measured on test pieces of the CCT760 type (2ao=253 mm), in the L-T direction and in the T-L direction, of at least 150 MPa√m and a tensile yield strength$R_{P0.2}$ in the L and TL directions of at least 360 MPa, a toughness under plane strain stress Kr60, measured on test pieces of the CCT760 type (2ao=253 mm), in the L-T direction and in the T-L direction, greater than 200 MPa√m and an ultimate tensile strength Rm in the L and TL directions of at least 410 MPa, and at least one of the following properties:

a ratio between the toughness under plane strain stress Kapp, measured on test pieces of the CCT760 type (2ao=253 mm), in the T-L and L-T directions, Kapp(T-L)/Kapp (L-T), of between 0.85 and 1.15 a ratio between the ultimate tensile strength Rm in the L and TL directions, Rm(L)/Rm(TL), of less than 1.06.

2. A plate according to claim 1, wherein the copper content is between 2.9 and 3.1% by weight.

3. A plate according to claim 1, wherein the lithium content is between 0.55 and 0.75% by weight.

4. A plate according to claim 1, wherein the silver content is between 0.15 and 0.28% by weight.

5. A plate according to claim 1, wherein the magnesium content is between 0.3 and 0.5% by weight.

6. A plate according to claim 1, wherein a zirconium content is less than or equal to 0.04% by weight.

7. A plate according to claim 1, wherein the manganese content is between 0.2 and 0.45% by weight.

8. A method for manufacturing a plate with a thickness of 0.5 to 9 mm according to claim 1, wherein successively;

a) a liquid metal bath is produced so as to obtain an aluminum alloy consisting of 2.8 to 3.2% by weight Cu,
0.5 to 0.75% by weight Li,
0.1 to 0.3% by weight Ag,
0.2 to 0.7% by weight Mg,
0.2 to 0.6% by weight Mn,
0.01 to 0.15% by weight Ti, a quantity of Zn of less than 0.2% by weight, a quantity of Fe and Si of less than or equal to 0.1% by weight each, and unavoidable impurities to a proportion of less than or equal to 0.05% by weight each and 0.15% by weight in total, wherein a zirconium content is less than or equal to 0.05% by weight, and balance aluminum, b) an ingot is cast from said bath of liquid metal;

c) said ingot is homogenized at a temperature of between 480° C. and 535° C.;

d) said ingot is rolled by hot rolling and optionally cold rolling into a plate having a thickness of between 0.5 mm and 9 mm;

e) solution heat treatment is carried out at a temperature of between 450° C. and 535° C. and said plate is quenched;

h) said plate is stretched in a controlled manner with a permanent deformation set of 0.5 to 5%, the total cold deformation set after solution heat treatment and quenching being less than 15%; and i) aging is carried out, comprising heating to a temperature of between 130° and 170° C. for 5 to 100 hours, wherein anisotropy index of grains measured at half thickness in accordance with ASTM E112 by the intercept method in L/TC plane is less than 20.

9. A method according to claim 8, wherein the homogenization temperature is between 490° and 530° C.

10. A method according to claim 8, wherein during the hot rolling, a temperature above 400° is maintained up to a thickness of 20 mm.

11. A plate according to claim 1 in an aircraft fuselage panel.

12. The plate according to claim 1, wherein the lithium content is between 0.64 and 0.73% by weight.

13. The plate according to claim 1, wherein the magnesium content is between 0.35 and 0.45% by weight.

14. The plate according to claim 6, wherein the zirconium content is less than or equal to 0.03% by weight.

15. The plate according to claim 1, wherein the manganese content is between 0.25 and 0.45% by weight.

16. The plate according to claim 8, wherein the anisotropy index is less than 10.

17. The plate according to claim 1, wherein the titanium content is between 0.03 and 0.1% by weight.

18. The plate according to claim 1, wherein homogenization occurs at a temperature of between 480° C. and 535° C.

19. A plate according to claim 1, wherein the thickness is between 1.5 and 6 mm, and has in the T8 temper at least one of the following pairs of properties:

a toughness under plane strain stress Kapp, measured on test pieces of the CCT760 type (2ao=253 mm), in the L-T direction and in the T-L direction, of at least 150 MPa√m and a tensile yield strength$R_{P0.2}$ in the L and TL directions of at least 365 MPa, a toughness under plane strain stress Kr60, measured on test pieces of the CCT760 type (2ao=253 mm), in the L-T direction and in the T-L direction, greater than 200 MPa√m and an ultimate tensile strength Rm in the L and TL directions of at least 415 MPa, and at least one of the following properties:

a ratio between the toughness under plane strain stress Kapp, measured on test pieces of the CCT760 type (2ao=253 mm), in the T-L and L-T directions, Kapp(T-L)/Kapp (L-T), of between 0.90 and 1.10, a ratio between the ultimate tensile strength Rm in the L and TL directions, Rm(L)/Rm(TL), of less than 1.05.

* * * * *